United States Patent [19]

Watanabe et al.

[11] 4,103,612

[45] Aug. 1, 1978

[54] INK MIST TYPE HIGH SPEED PRINTER

[75] Inventors: Akinori Watanabe; Matsusaburo Noguchi; Toshimichi Ota, all of Tokyo, Japan

[73] Assignee: Oki Electric Industry Co., Ltd., Tokyo, Japan

[21] Appl. No.: 778,477

[22] Filed: Mar. 17, 1977

[30] Foreign Application Priority Data

Mar. 25, 1976 [JP] Japan ..... 51-31948

[51] Int. Cl.[2] ..... B41J 3/12; B41J 3/18

[52] U.S. Cl. ..... 101/1; 101/DIG. 13; 250/324; 346/159

[58] Field of Search ..... 101/1, DIG. 13; 197/1 R; 250/324, 325; 313/146; 346/75, 159

[56] References Cited

U.S. PATENT DOCUMENTS

| | | | |
|---|---|---|---|
| 3,397,136 | 8/1968 | Balough | 250/324 X |
| 3,890,504 | 6/1975 | Pendleton et al. | 101/DIG. 13 |
| 3,943,848 | 3/1976 | Watanabe et al. | 101/DIG. 13 |
| 3,983,801 | 10/1976 | Watanabe et al. | 101/DIG. 13 |

*Primary Examiner*—Paul T. Sewell
*Attorney, Agent, or Firm*—Peter L. Berger

[57] ABSTRACT

This invention provides an ink mist type high speed printer comprising a first electrode and a second electrode between which a high voltage is applied, and an aperture board disposed between the first and second electrodes and adapted to selectively control passage of the ions generated from the second electrode, wherein a stream of ink mist is passed between the aperture board and first electrode so that the ions which have passed the aperture board will selectively charge the ink mist particles to let the charged ink mist particles deposit on a recording paper placed between the ink mist and first electrode to thereby print a desired dot matrix character. The first electrode is divided along its length into plural segments such that the respective segments may be separated individually from the aperture board, and the width of the first electrode is determined in correspondence to the width of the recording paper while controlling the width of the first electrode opposed to the second electrode so as to eliminate the possibility of deposition of ink mist on the aperture board.

6 Claims, 7 Drawing Figures

INK MIST TYPE HIGH SPEED PRINTER

BACKGROUND OF THE INVENTION

This invention relates to an ink mist type high speed printer.

The increasing trend toward speed-up of the central processing unit of the electronic computer system is necessitating corresponding speed-up of the printers which are out put terminal units of such computer system. There are known various types of high speed printers among which is a so-called ink mist type high speed printer in which the ink mist particles electrically charged by the ions are moved to the recording paper by an electrostatic force to thereby print the desired characters, etc., by way of dot matrices.

FIG. 1 shows diagrammatically the printing section of a known ink mist type high speed printer. According to this printer, a positive electrode (second electrode) 2 called as corona wire and a negative electrode (first electrode) 4 surrounded by an insulator 3 are arranged in opposition to each other so that a recording paper 1 fed at high speed passes therebetween, and a high voltage of several thousand volts is applied between these two electrodes. The first electrode 4 is housed in a back bar 5 adapted to hold the recording paper 1 at the correct printing position. Provided between said back bar 5 and second electrode 2 is an aperture board 6 designed to serve as a gate means for controlling movement of the ions. In the upper portion of said aperture board 6 are provided a plurality of apertures 7 arranged along the length of the aperture board (6) for allowing passage of the ions. Between said aperture board 6 and recording paper 1 is formed a stream of ink mist 10 as the ink particles are supplied in an atomized form from a mist tank 8 along with air from an air outlet 9. The cations impinge against this stream of ink mist to let the ink particles migrate toward the first electrode 4. Thus, if the cations are selectively passed by controlling the direction of the electric field in said apertures 7, the ink particles are deposited in the form of a matrix pattern on the recording paper 1.

In such known high speed printer, the first electrode 4 is constituted from a single piece of conductor common to the entire printing area. Therefore, when printing is made on a paper which is smaller in width than the ordinary (standard) printing paper, a certain portion of the back bar 5 is directly positioned in the space where the ions move, that is, such portion is opposed to the aperture board 6 with no interposition therebetween. In such a case, flocks from the recording paper 1 or dust in the air could deposit on the back bar 5, and such dust is charged negatively and attracted to the aperture board 6 which is higher in potential than the first electrode 4. As such dust passes through the ink mist, it is impregnated with ink particles to cause soiling of the aperture board 6 or clogging of the apertures 7. If such situation is produced, the cations become unable to pass the apertures 7, and the common electrode 11 provided on the front side of the aperture board 6 and the selection electrode 12 provided on the back side thereof become conductive to each other to disenable control of passage of the cations. This gives rise to various problems such that no printing is made on the paper portion corresponding to such trouble area when printing is performed thereafter on a normal-sized printing paper, or that the printing quality is reduced.

SUMMARY OF THE INVENTION

The present invention provides an ink mist type high speed printer in which the first electrode is divided along its length into plural segments so that the respective segments may be separated individually from the aperture board and may be also arranged so as not to be directly opposed to said board, and the width of the first electrode is determined in correspondence to the width of the recording paper used while controlling the width of the first electrode opposed to the aperture board to eliminate the possibility of the dust to fly to and deposit on the aperture board portion which extends out from the span of the recording paper, thereby preventing soiling of the aperture board with ink and clogging of the apertures and allowing perfect printing with no change of print quality when printing is performed thereafter on a recording paper with a greater width.

OBJECTS OF THE INVENTION

The first object of this invention is to provide an improved arrangement for an ink mist type high speed printer in which the first electrode is divided along its length into plural segments such that the respective segments may be separated away individually from the aperture board and may be also arranged so as not to be opposed to said board, and the first electrode is opposed to the aperture board with the width of said electrode being selected in conformity to the width of the recording paper used, with the other portion of the first electrode being separated away to eliminate any risk of deposition of flocks or cuts of the recording paper on the aperture board.

The second object of this invention is to provide an improvement in which the segments of the first electrode positioned outside the span determined in correspondence to the width of the recording paper used are separated away so that they are not opposed to the aperture board, thereby inhibiting the dust on the first electrode from migrating to the aperture board.

The third object of this invention is to eliminate any possibility of soiling of the aperture board with ink by inhibiting migration of the dust deposited on the first electrode by making arrangement such that the first electrode segments outside the span determined in accordance with the width of the recording paper used will not be opposed to the aperture board.

The fourth object of this invention is keep the cation outlets of the aperture board free from deposition of ink or dust.

The fifth object of this invention is to eliminate any possibility that the common electrode provided on the front side of the aperture board and the control electrodes provided on the back side thereof be brought into a conductive state relative to each other by deposition of ink or dust to disenable the cation passage controlling function.

The sixth object of this invention is to constitute the back bar from plural segments arranged along the length thereof like the first electrode, with an end of each segment of the back bar being arranged pivotally turnable to allow the indivisual electrode segments to separate away from the aperture board so as not to oppose thereto.

DETAILED DESCRIPTION OF THE INVENTION

Figure 1:
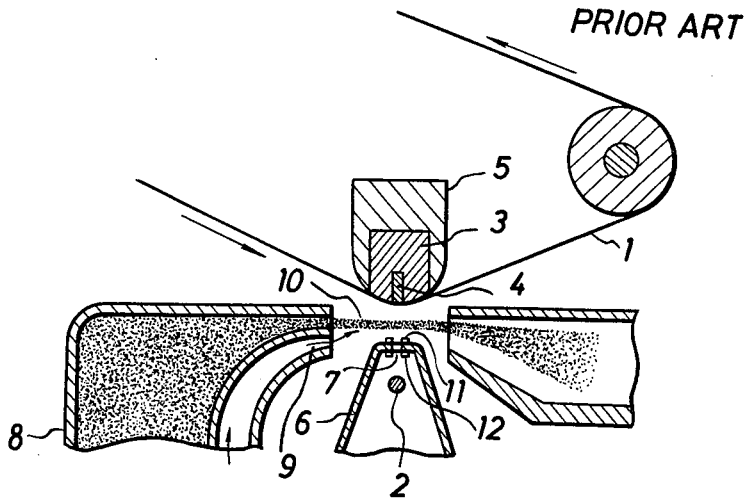
FIG. 1 is a transverse sectional view showing the printing section of a conventional ink mist type high speed printer.
Figure 2:
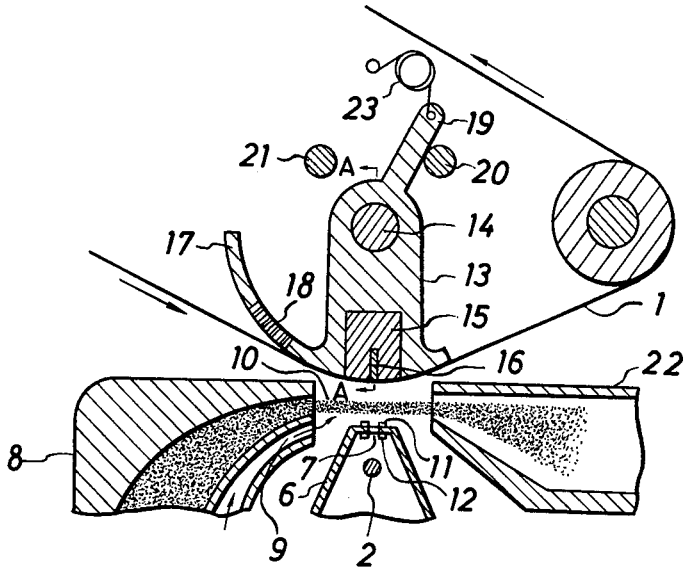
FIG. 2 is a transverse sectional view showing the printing section of an ink mist type high speed printer according to the present invention, showing a condition where all the segments of the first electrode are joined together.
Figure 4:
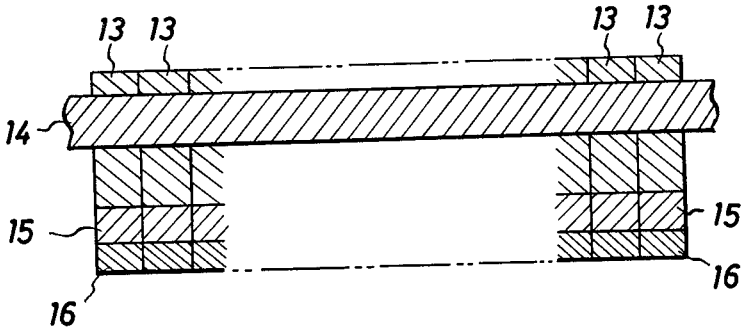
FIG. 4 is a sectional view of the back bar taken along the line A—A of FIG. 2, showing a condition where all the segments of the first electrode are joined together.

FIG. 2 shows the printing section of an ink mist type high speed printer according to the present invention. The back bar 13, as shown in FIG. 4, is divided into plural segments along the length thereof and the respective segments are pivotally supported by a shaft 14 so that they are swingable independently of each other. The portion of each said back bar segment 13 facing the printing section is curved arcuately, and a corresponding segment of first electrode 16 surrounded by an insulator 15 is provided at the lower portion of each said back bar segment so as to oppose the apertures 7. Also, a part of its arcuate extension 17 has both its side ends insulated by an insulator 18. At the top of each said back bar segment 13 is provided an arm 19 so that one can turn any segment of the back bar 13 by manually operating such arm 19. At suitable positions on both sides of said arm 19 are provided stoppers 20 and 21 so that each back bar 13 can be stopped at two different positions.

Numeral 6 designates an aperture board which comprises a common electrode 11, a plurality of selection electrodes 12 and a plurality of apertures 7 as in the conventional devices. This aperture board 6 is so designed that the cations produced from the second electrode 2 connected to a positive power source (not shown) are permitted to pass through the apertures 7 only when the selection electrodes 12 are earthed or selected to a positive potential with relation to the common electrode 11 which is of a relatively low positive potential.

There is also provided an ink tank 8 from which the ink particles are supplied in an atomized form together with air supplied from an air outlet 9 to form a stream of ink mist 10. Numeral 22 indicates a mist suction portion, and 23 a coil spring.

Figure 3:
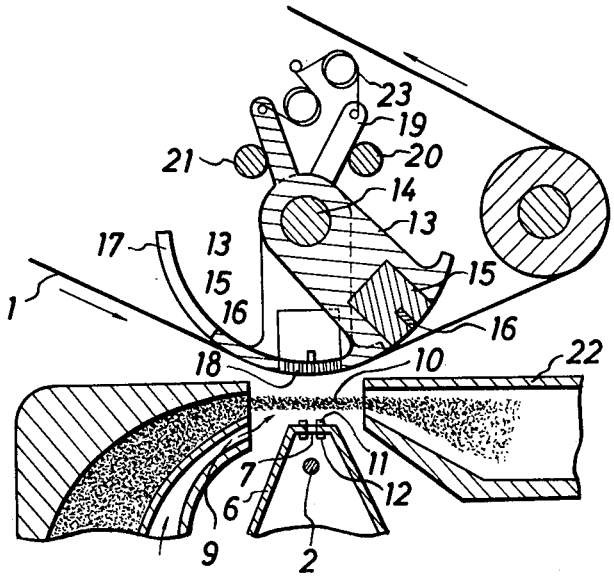
FIG. 3 is a similar view to FIG. 2 but showing a condition where a part of the first electrode is separated away.
Figure 5:
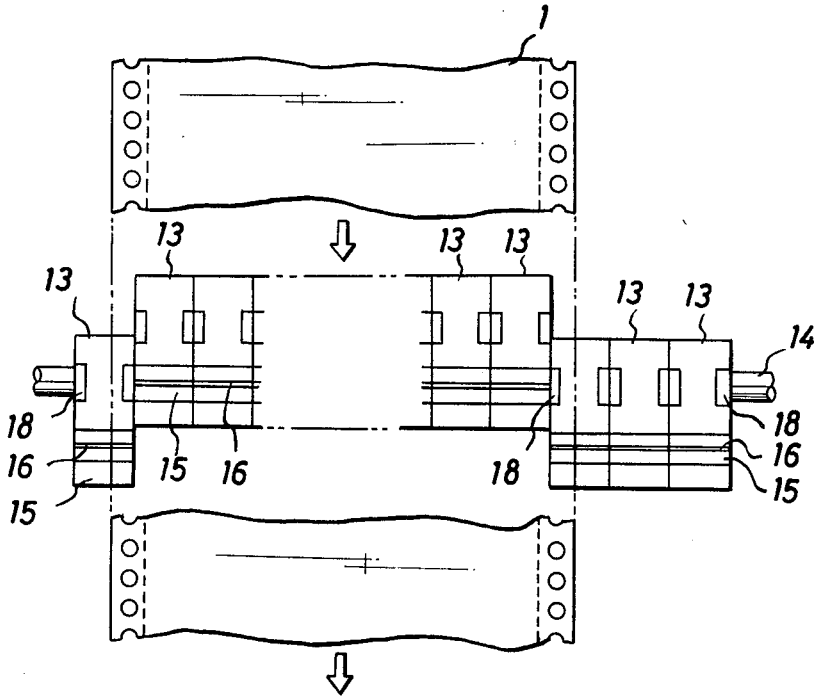
FIG. 5 is a view taken from the lower side of the back bar of FIG. 3, showing the relationship between the recording paper and the back bar in a condition where a part of the first electrode is separated away.

Now, the operation of the just described high speed printer of this invention is described with particular reference to FIGS. 3 and 5.

When the recording paper 1 is set in position, the range of turning movement of each back bar 13 is also adjusted in accordance with the width of said recording paper 1. Any back bar or bars 13 positioned outside of the span of the recording paper 1 are manually turned counterclockwise as shown in FIG. 3 so that the first electrode 16 is not opposed to the apertures 7 in a spaced-apart relation and instead the insulator 18 at the arcuate extension 17 of each back bar 13 is opposed to the apertures 7. In this way, the insulator 18 of each turned back bar 13 is positioned adjoining to the first electrode 16 of the corresponding non-turned back bar 13 to electrically separate said both back bars as shown in FIG. 5.

If the positional adjustment of each back bar 13 is made in conformity to the width of the recording paper 1 in the manner described above, the first electrode 16 of each turned back bar 13 is spaced away greatly from the aperture board 6 and also kept away from the space where the ink mist exists as shown in FIGS. 3 and 5, so that such back bar is not opposed to the second electrode 2 and hence the electrically charged dust won't be attracted to the aperture board 6. This also eliminates any chance of the dust to pass through the ink mist. Thus, the portion of the aperture board 6 extending beyond the span of the recording paper 1 won't be soiled with ink and also no clogging of the apertures 7 takes place, thus allowing perfect printing, with no change of print quality, when the next printing operation is performed on a recording paper with different width.

Figure 6:
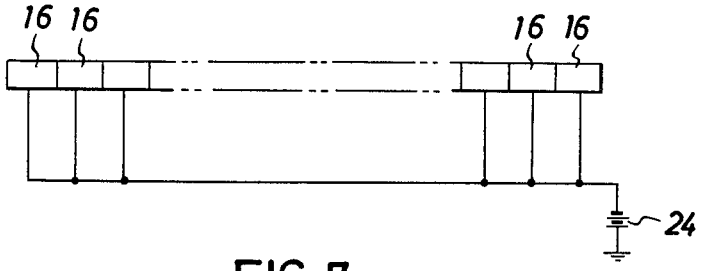
FIG. 6 is a wiring diagram of the respective segments of the first electrode and negative power source.
Figure 7:
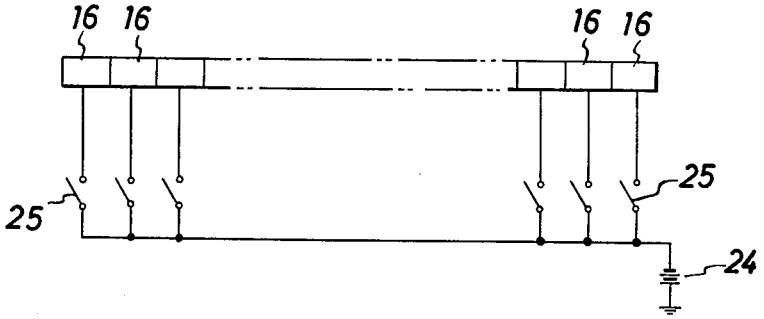
FIG. 7 is a wiring diagram of the respective segments of the first electrode and negative power source, with switches being provided for said respective segments.

FIG. 6 shows a wiring diagram of an embodiment of this invention where each first electrode 16 is connected directly to a negative power source 24, and FIG. 7 shows a wiring diagram of another embodiment where each first electrode 16 is connected to a negative power source 24 through a switch 25. According to the latter embodiment, the first electrode 16 of each back bar can be cut off from the negative power source 24 by means of the corresponding switch 25 with turn of said back bar, so that the dust existing around the cut-off first electrode 16 won't be electrically charged. This ensures even more positive protection of the aperture board 6 against ink soiling.

Although the first electrode spacing operation is made manually in the described embodiment, such operation may be performed by an electric or mechanical means to allow automatic movement in accordance with the width of the recording paper.

According to the present invention as described above by way of an embodiment, there is created no situation liable to cause soiling of the aperture board with ink even when using a recording paper having a smaller width than the length of the aperture board, and hence it is possible to always maintain high print quality irrespective of the width of the recording paper used.

Also, in case of using a recording paper having a sprocket hole in the center, if the first electrode at the position corresponding to such sprocket hole is kept spaced away, it is possible to prevent the electrically charged dust from flying out from such hole toward the aperture board.

Thus, the present invention increases the degree of freedom of the recording papers used to widen the scope of utility as printer.

What is claimed is:

1. An ink mist type high speed printer comprising a first electrode and a second electrode between which a high voltage is applied, an aperture board disposed between said first and second electrodes and adapted to selectively control passage of ions generated from the second electrode, a back bar containing said first electrode, said back bar being in opposed relation to said aperture board, and means for generating a stream of ink mist between said aperture board and said first electrode, wherein the ink mist particles are selectively charged by the ions which have passed said aperture board and the electrically charged ink mist particles are attracted by the first electrode to print desired characters on a recording paper placed on said first electrode, and further characterized in that said back bar and said contained first electrode are divided along their lengths into plural segments so that the respective back bar segments and their respective contained first electrode segments may be separated and moved individually away from the aperture board, and a shaft extending across said printer upon which are rotatably mounted said back bar segments, each of said back bar segments comprising an insulator spaced apart from said contained first electrode segment, each of said back bar segments being rotatable on said shaft, said back bar segments being rotated to present said first electrode having a length corresponding to a desired printing width, said next adjoining back bar segments on both sides of the outer ones of said rotated back bar segments presenting said insulator, such that an insulator is located on both sides of said rotated back bar segments adjoining said first electrode.

2. An ink mist type high speed printer as set forth in claim 1, wherein said first electrode and said back bar are divided into plural segments along the length thereof.

3. An ink mist type high speed printer as set forth in claim 2, wherein said respective segments of said first electrode and back bar and joined to each other so that they are free to turn.

4. An ink mist type high speed printer as set forth in claim 3, wherein each of said back bar segments is provided with an insulator at the location where said segment is juxtaposed with the first electrode of the adjoining back bar segment when the first-said back bar segment was turned to a stop position with the associated first electrode being kept away from the printing section.

5. An ink mist type high speed printer as set forth in claim 1, wherein a switch is provided between each segment of the first electrode and a corresponding power source.

6. The invention of claim 1, wherein each of said back bar segments comprises a main segment and an integrally formed arcuate section, said first electrode segments being located on said main segment and said insulator being located on said arcuate section.

* * * * *

UNITED STATES PATENT AND TRADEMARK OFFICE

CERTIFICATE OF CORRECTION

PATENT NO. : 4,103,612

DATED : August 1, 1978

INVENTOR(S) : Akinori Watanabe et al.

It is certified that error appears in the above-identified patent and that said Letters Patent are hereby corrected as shown below:

Column 6, line 9, change "and" (2nd occurrence) to -- are--.

Signed and Sealed this

*Sixth* Day of *February 1979*

[SEAL]

*Attest:*

RUTH C. MASON
*Attesting Officer*

DONALD W. BANNER
*Commissioner of Patents and Trademarks*